US007223212B2

(12) United States Patent
DiOrio et al.

(10) Patent No.: US 7,223,212 B2
(45) Date of Patent: May 29, 2007

(54) DEVICE AND KIT FOR BODY STRETCHING

(76) Inventors: Susan C. DiOrio, 3836 Marburg Ave., Cincinnati, OH (US) 45209-1838; Stephen M. Sallada, 3836 Marburg Ave., Cincinnati, OH (US) 45209-1838

( * ) Notice: Subject to any disclaimer, the term of this patent is extended or adjusted under 35 U.S.C. 154(b) by 126 days.

(21) Appl. No.: 10/707,236

(22) Filed: Nov. 29, 2003

(65) Prior Publication Data

US 2005/0130812 A1 Jun. 16, 2005

(51) Int. Cl.
*A63B 2/10* (2006.01)
*A63B 2/00* (2006.01)

(52) U.S. Cl. ..... 482/83; 482/83; 482/91; 482/907

(58) Field of Classification Search ..... 482/83, 482/91, 92, 121, 124, 131, 907
See application file for complete search history.

(56) References Cited

U.S. PATENT DOCUMENTS 3,843,119 A * 10/1974 Davis ..... 482/131
5,004,228 A 4/1991 Powers
5,069,449 A 12/1991 Wardwell
5,209,712 A * 5/1993 Ferri ..... 482/91
5,456,213 A * 10/1995 Beauchamp ..... 119/793
5,518,486 A * 5/1996 Sheeler ..... 482/131
5,540,188 A 7/1996 Heinrichs
5,595,559 A 1/1997 Viel
5,624,359 A 4/1997 Dean
D381,473 S * 7/1997 Dixon et al. ..... D30/153
5,749,325 A * 5/1998 Albanese ..... 119/792
5,807,218 A * 9/1998 Nagatomo ..... 482/124
5,813,954 A * 9/1998 Wilkinson ..... 482/124
5,921,903 A * 7/1999 Lawrence ..... 482/140
6,322,482 B1 * 11/2001 Kim ..... 482/124
6,368,255 B1 4/2002 Chan-Rouse
6,436,020 B1 * 8/2002 Weingand ..... 482/148
6,921,354 B1 * 7/2005 Shifferaw ..... 482/91

* cited by examiner

*Primary Examiner*—Cary E. O'Connor
(74) *Attorney, Agent, or Firm*—Daniel F. Nesbitt; Hasse & Nesbitt LLC

(57) ABSTRACT

A device for use in assisting a person to stretch a targeted tissue in the body. The stretching device consists of a long, inelastic strap with a fixed loop at one end, and a connector on the other end. The connector has a fixed part and a movable part that, when connected together, form a second loop at the second end of the strap, of varying size. The device is used in combination with instructions that inform the user of the proper use of the device to stretch a targeted tissue in the body. Packaging of the device and the instructions together provides a convenient kit for use in stretching exercises for the body.

19 Claims, 5 Drawing Sheets

DEVICE AND KIT FOR BODY STRETCHING

BACKGROUND OF INVENTION

The present invention relates to a device in a kit for stretching the body.

A regular program of physical exercise is important to the physical and mental health of persons. Many people exercise at health and exercise facilities under the guidance and instruction of a trained exercise director. Other persons exercise alone or at home. Exercise takes on a variety of routines, including, but not limited to, yoga, martial arts, aerobics, swimming, running, cross-training, and gymnastics.

The stretching of the muscles, ligaments and other body tissues improves flexibility, reduces muscle cramping and strains or other forms of injuries, and improves exercise performance and endurance. Safely stretching tight muscles prior to an activity may help prevent soft tissue trauma during activities. Re-stretching during the cool-down phase after the completion of the activity minimizes muscle soreness and helps to elongate tissues that may become tight during the activity.

SUMMARY OF INVENTION

The present invention relates to an exercise device for use in assisting a person to stretch a targeted tissue in the body, comprising: a) a flexible, inelastic strap having a first end, and a second end, and having a fixed loop formed at the first end; b) a connector assembly comprising: i) a movable member configured for positioning along the length of the strap, and ii) a fixed member that is attached to the second end of the strap, wherein connector has a connected configuration wherein the movable member and the fixed member are releasably connected, thereby forming a second loop proximate the second end of the strap, and a disconnected configuration wherein the movable member and the fixed member are not connected.

The present invention also relates to a kit for use in assisting a person to stretch a targeted tissue in the body, comprising: a) the exercise device, b) instructions that inform a user of the proper use of the device to stretch a targeted tissue in the body; and c) a means for securing the device and the instructions.

DETAILED DESCRIPTION

Figure 1:
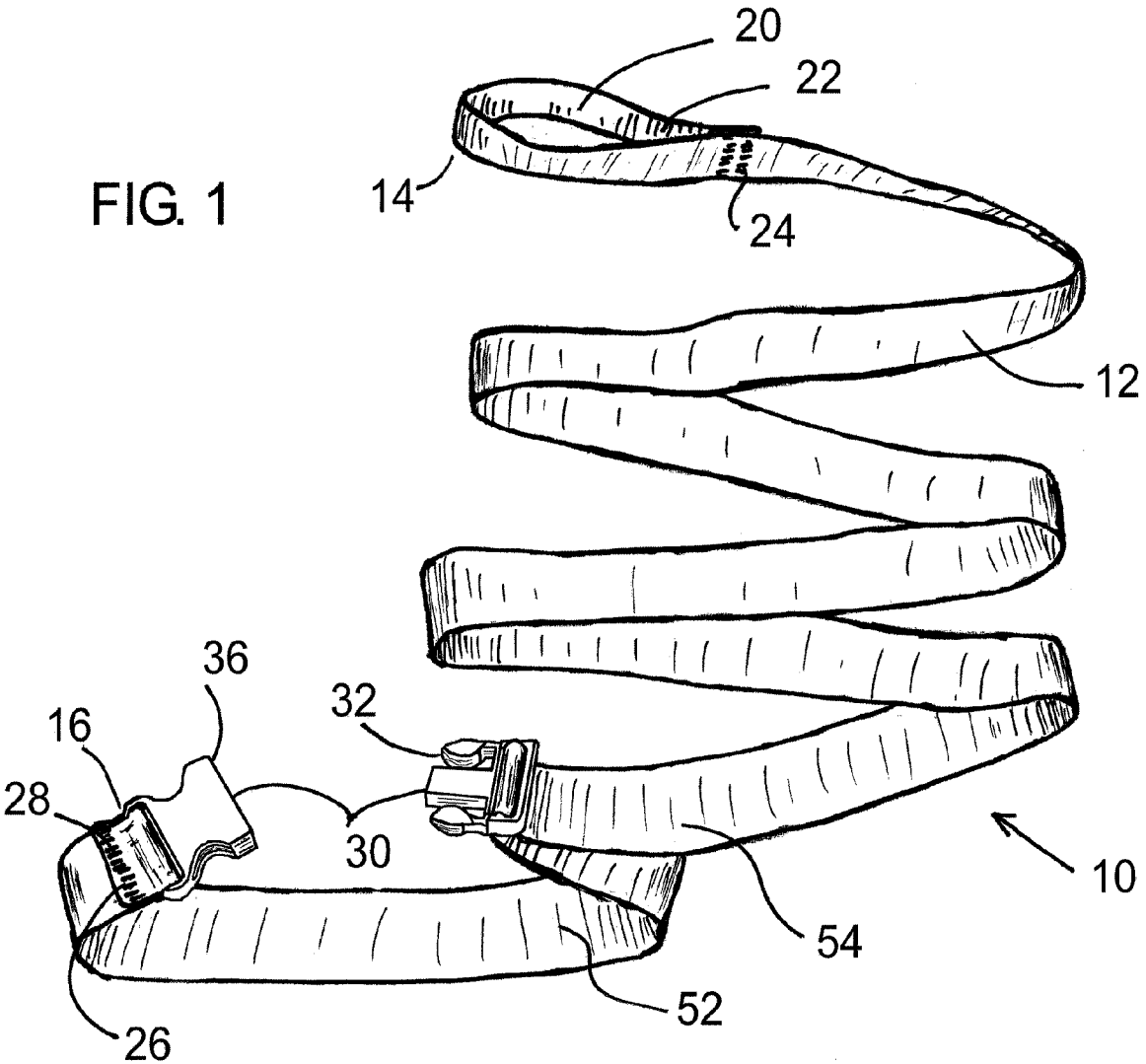
FIG. 1 shows a perspective view of an exercise device of the present invention with a connector assembly in a disconnected configuration.

FIG. 1 shows an embodiment of an exercise device 10 of the present invention. The device includes an elongated member shown as a length of a flexible strap 12 and a connector assembly 30. The strap 12 has a first end 14 and a second end 16. The strap is inelastic and is typically made of a polypropylene, nylon or other thermoplastic, resilient woven material, but could be made of cotton, hemp, or other natural fiber woven material. The strap typically has a width of at least about 1.5 inches, and up to about 4 inches, and more typically of at least about 2 inches. The strap 12 typically has a length, from the first end 14 to the second end 16, with the connector 30 in the disconnected configuration, of about 8 feet, and up to about 12 feet, and more typically of about 10 feet.

The connector assembly 30 comprises a movable member 32 configured for positioning along a portion of the length of the strap 12, and a fixed member 36 that is attached to the second end 16 of the strap. The movable member 32 has a pair of adjoining slots through which the length of strap can pass and thereby engage with the movable member 32, thereby providing a loop-forming portion 52 of strap that extends from the movable member 32 toward the second end 16, and a trailing portion 54 of strap that extends from the movable member 32 toward the first end 14. The movable member 32 can be positioned along the length of the strap 12 by grasping the movable member and pulling on either the loop-forming portion 52 or trailing portion 54 of strap 12, so that the strap passes through the slots of the movable member 32.

The connector assembly 30 also comprises a fixed member 36 configured for attachment to the second end 16 of the strap. A typical attachment of the fixed member 36 is made by passing a leading portion 26 of the strap stock proximate the second end 16 through a slot in the fixed member 36, folding the leading portion back onto the strap, and securing the leading portion 26 to the strap with a securement, such as stitching 28.

A typical connector assembly is a snap buckle, such as an Airloc Side Release Buckle, available from ITW Nexus U.S, Des Plaines, Ill., or a Side Release Buckle, available from Fasnap® Corporation, Elkhart, Ind. Such snap buckles are typically made of a plastic material and are available in a variety of sizes to accommodate straps of various widths.

The strap has a fixed loop 20 formedproximate the end 14 by folding a leading portion 22 of the strap stock back onto mid-length portion of the strap, and securing the leading portion 22 to the mid-length portion with a securement, such as stitching 24. The fixed loop 20 is configured for fitment over a user's foot, hand, leg, or arm during the stretch exercise. The fixed loop typically has a circumference of at least about 14 inches, and up to about 18 inches, and more typically of about 16 inches.

Figure 2:
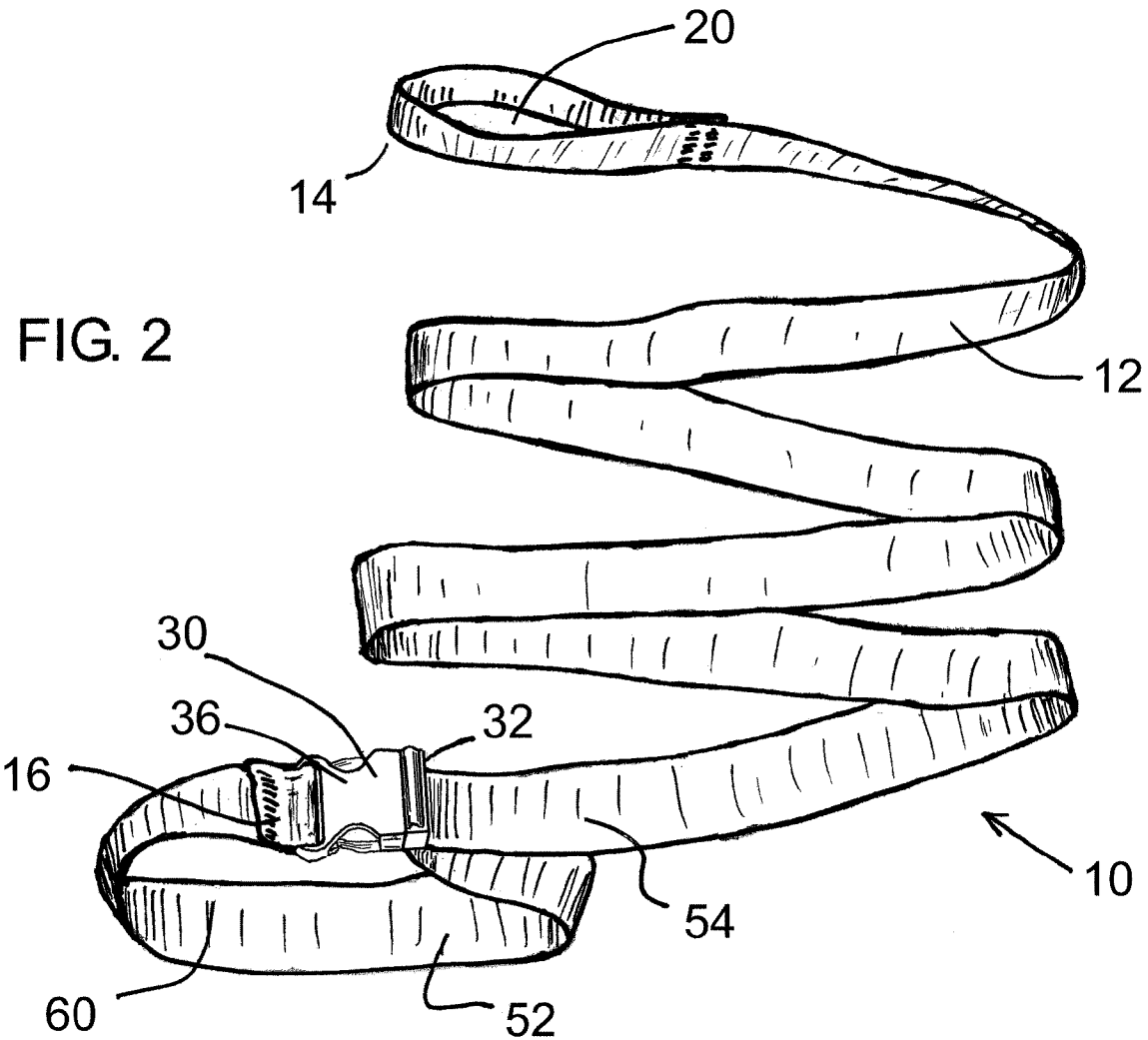
FIG. 2 shows a perspective view of the exercise device of FIG. 1 in a connected configuration.

As shown in FIG. 2, the connector assembly 30 has a connected configuration wherein the fixed member 36 and the movable member 32 are connected together, thereby forming a second loop 60 proximate the second end 16 of the strap. Typically, the connector assembly 30 is configured with a release button or other means for releasing the fixed member 36 from the movable member 32, into the disconnected configuration shown in FIG. 1.

Other connectors can be used to releasably connect the second end 16 with a mid-length portion of the strap 12 to form the second loop 60 of varying circumference. Non-limiting examples of such other connectors can include a mechanical hook and loop fastener, cap and button snaps, and others.

The size of the second loop can be varied by grasping the connector assembly 30 and pulling on either the loop-forming portion 52 or trailing portion 54 of the strap. Pulling on the loop-forming portion 52 will cause the second loop 60 to become larger in circumference, while pulling on the trailing portion 54 will cause the second loop 60 to become smaller in circumference.

The connector assembly 30 is configured to resist movement along the length of the strap while the device, in its connected configuration, is in use. That is, the connector assembly 30 resists movement along the strap 12 when opposed forces are applied to the loop 60 and to the trailing portion 54 of the strap.

Figure 5:
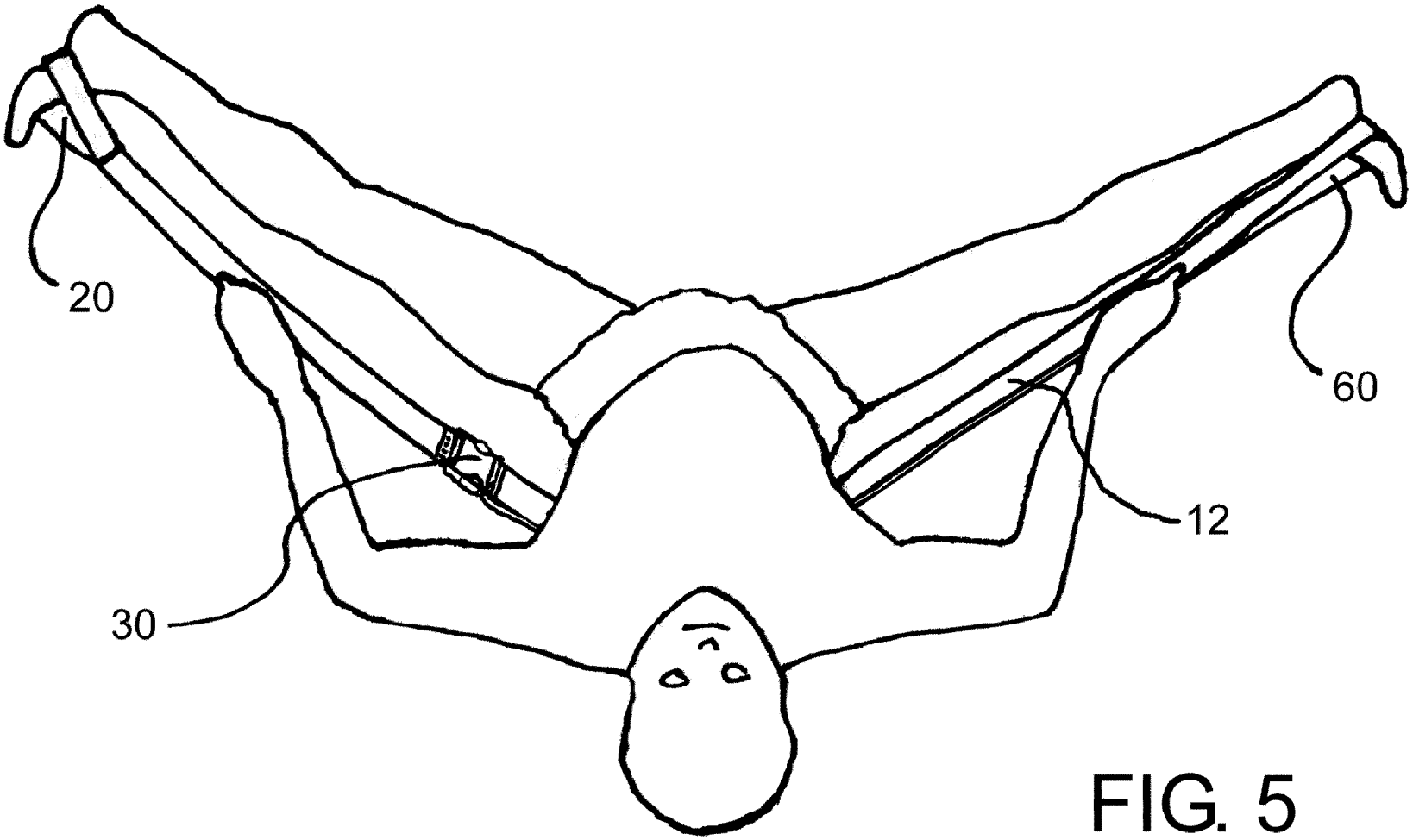
FIG. 5 shows a perspective view illustrating a person using the exercise device illustrated in FIG. 2 to stretch muscles in the inner thighs and groin.

The exercise device 10 can be used in one or more configurations for use in assisting a person to stretch a targeted tissue in the body. One device configuration provides use of the device with the connection assembly in a disconnected configuration, having only a fixed loop 20. In this configuration, the user can grasp and restrain the strap at a point along the mid-length of the device. Another device configuration provides use of the device with the connection assembly 30 in a connected configuration having both the first loop 20 and the second loop 60. In various alternative configurations of the exercise device having both the first loop and the second loop 60, the position of the movable member 32 can be varied to provide the second loop 60 with correspondingly varied circumferences. One such configuration provides the second loop 60 with a circumference of at least about 14 inches to about 18 inches, and more typically of about 16 inches, but can be up to nearly the entire length of the remaining part of the strap. Since the size of the second loop 60 can be adjusted, the overall length of the strap 12, from the first end 14 of the fixed loop 20 to a distal end of the second loop 60, can correspondingly vary. The adjustability of the size of the second loop 60 allows for fine adjustment of the overall length of the strap. The fine adjustment of the overall length of the strap 12 can provide more effective use of the device by persons of all sizes while performing a wide variety of stretching exercises. In this configuration, the user may use only the expandable second loop 60, or may use both the fixed loop 20 and the second loop 60, as illustrated in FIG. 5.

Another embodiment of the present invention is a kit for use in assisting a person to stretch a targeted tissue in the body. The kit comprises an exercise device as described herein above, and instructions that inform a user of the proper use of the device to stretch a corresponding plurality of targeted tissues in the body. The kit also comprises a means for securing the exercise device with the instructions.

The instructions can be in a variety of forms that can explain or show the user the proper use of the exercise device in stretching a targeted tissue of the body. Typically, the targeted tissue is a muscle, a ligament, a tendon, and combinations thereof. More typically, the instructions inform the user of a plurality of proper uses of the device, to stretch a corresponding plurality of targeted tissues in the body. The instructions can be observed and used directly by a user of the exercise device, or can be observed by an instructor, who then directs the user in the proper use of the device.

Figure 3:
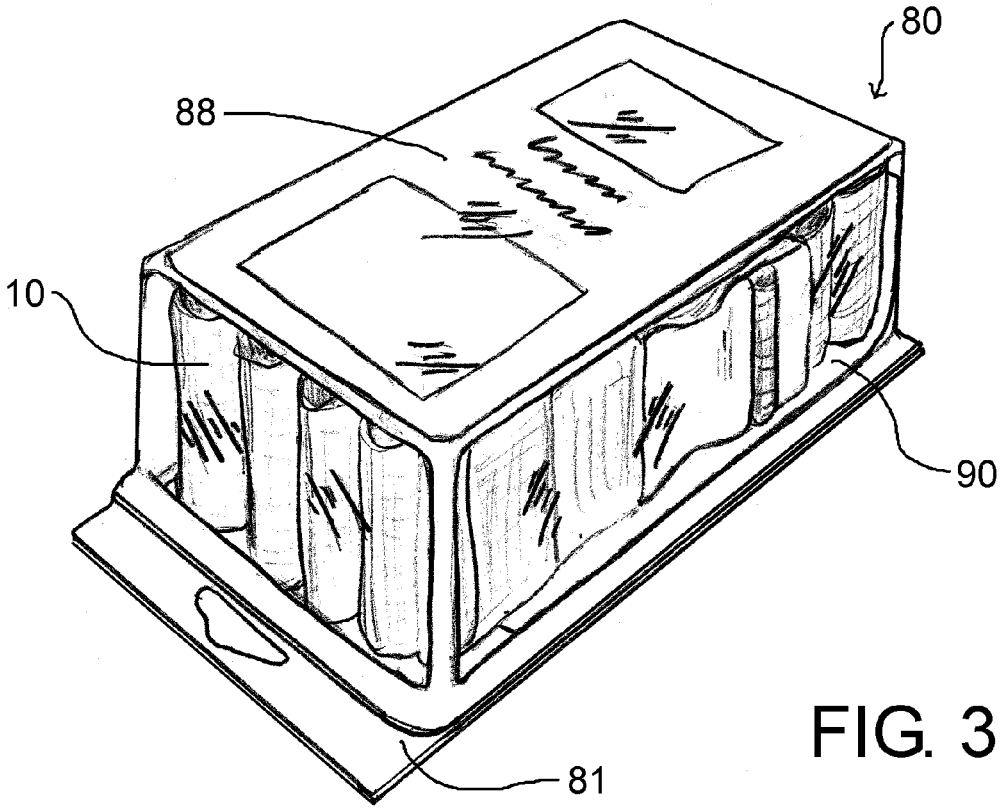
FIG. 3 shows a perspective view of a kit of the present invention consisting of a closed container containing an exercise device and instructions for proper use of the device for stretching.

A typical securement means for the kit comprises a package that encloses the exercise device and the instructions. Typically, the package is closed for shipment and storage of the kit, such as for transportation through commerce to a retail or wholesale store, or to a facility (including, but not limited to, an exercise facility, rehabilitation facility, hospital, clinic, yoga studio, martial arts training center, or a residence) where the device will be used. As shown in FIG. 3, a typical package is a closed transparent thermoplastic container 80 that has a backopening that is initially covered by a secured, hinged lid 81. A set of written instructions 90 are folded and positioned within the container. The exercise device 10 is typically rolled or folded, and placed within the container 80. The container can have a label 88 for commercial purposes that can be positioned and secured on the inside of the container, facing outward, as shown in FIG. 3, or on the outside of the container. The container 80 can be sized depending upon the length and width of the strap of the exercise device, and on the type and quantity of instructions. For example, when the instructions include a video tape, the container should be sized with dimensions to contain the videotape.

Another embodiment of a kit of the invention uses a securement means that comprises a shrink-wrap plastic film, or a plastic bag that is secured closed to contain the exercise device and instructions.

The instructions are selected from the group consisting of written instructions, pictorial instructions, audio instructions, video instructions, and mixtures thereof. Typically instructions include a combination of written instructions and pictorial instructions, in the form of an instruction sheet or card.

Figure 4:
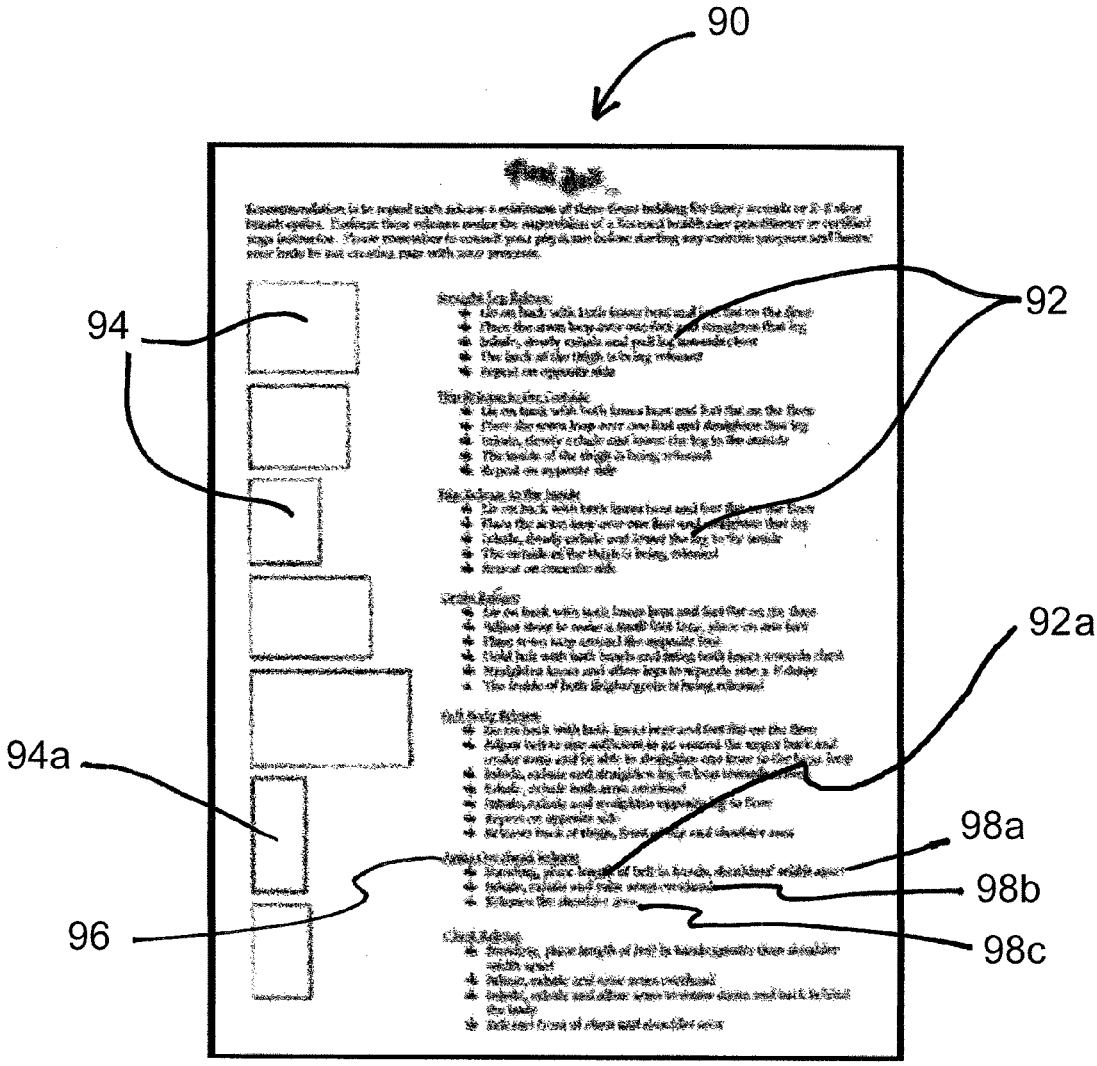
FIG. 4 shows an instruction sheet for use in the kit of FIG. 3 that informs a user of the proper use of the device.

FIG. 4 shows an instruction as an instruction sheet 90 comprising a plurality of written exercise instructions 92 and a corresponding plurality of pictorial instructions 94.

A typical written exercise instruction 92*a* includes a description heading 96 and (one or) a plurality of steps 98*a*, 98*b*, and 98*c* of a method of using the exercise device in stretching a targeted tissue of the body. The written exercise instruction 92*a* is proximally associated with a pictorial instruction, shown as image 94*a*, to assist in understanding the instruction for using the device. Each written exercise instruction 92 can be directed to a different targeted tissue of the body for stretching, such as calf muscles, hamstring muscles, and others.

The instructions can be used to direct the user in a wide variety of stretching exercises. Typical examples include a straight leg stretch or release (release is an alternative term for stretching), hip release to the outside or to the inside, groin release, full body release, arms overhead release, and chest release. One example of an exercise instruction is provided for a stretching exercise called "groin release". The written instruction sheet includes the written exercise instructions, shown in Table A, in combination with a pictorial image, such as FIG. 5, to improve the understanding and proper performance of the stretch exercise.

TABLE A

| Groin Release | |
|---|---|
| Step No. | |
| 1 | Lie on back with both knees bent and feet flat on the floor. |
| 2 | Place the sewn (fixed) loop over the toes of one foot, and pass the expandable (second) loop under the trunk of the body. |
| 3 | Adjust the size of the expandable (second) loop to fit over the toes of the other foot. |
| 4 | Hold the belt with both hands and bring the knees toward the chest. |
| 5 | Straighten the knees and allow the legs to separate into a "V" shape, as shown in the photo (FIG. 5). |
| 6 | Readjust the size of the expandable loop, as needed, to obtain release of the muscles and other tissues in the inside of both thighs and the groin. |

Another example of an exercise instruction is provided for a stretching exercise called "Straight Leg Release", with written exercise instructions shown in Table B.

TABLE B

| Straight Leg Release | |
|---|---|
| Step No. | |
| 1 | Lie on back with both knees bent and feet flat on the floor. |
| 2 | Place the sewn (fixed) loop over one foot and straighten that leg. |
| 3 | Inhale, and then slowly exhale while pulling the leg towards the chest. |
| 4 | The muscles and other tissues in the back of the thigh are being released. |
| 5 | Repeat on the opposite leg. |

Yet another example of an exercise instruction is provided for a stretching exercise called "Chest Release", with written exercise instructions shown in Table C.

TABLE C

| Chest Release | |
|---|---|
| Step No. | |
| 1 | Standing erect, place the length of the strap in both hands, with the hands extended greater than shoulder width apart. |
| 2 | Inhale, exhale, and then raise the extended hands overhead. |
| 3 | Inhale, exhale, and then allow the extended arms to rotate down and back behind the body. |
| 4 | The muscles and other tissues in the front of the chest and shoulders are being released. |

The exercise device can be used by a user in a variety of positions, including a standing position, a seated position, a lying position, and other relaxed positions for effective stretching of the body.

Another example of an instruction includes an audio/video tape or DVD, which includes a video demonstration of one or more of the stretching exercises, performed by an instructor, in combination with oral instructions on the stretching technique. Another example of an instruction includes a digital file that can be provided on permanent or semi-permanent digital recording media, such as a CD-ROM or a floppy disk, or can be downloaded from the Internet, and presented by displaying the digital file on a digital file player such as a computer having a video monitor and audio speakers.

While specific embodiments of the apparatus and method of the present invention have been described, it will be apparent to those skilled in the metalworking arts that various modifications thereto can be made without departing from the spirit and scope of the present invention as defined in the appended claims.

The invention claimed is:

1. An exercise device for use in assisting a person to stretch a targeted tissue in the body, comprising:

a) a flexible, inelastic strap having a first end, and a second end, and having a fixed loop formed in the flexible strap at the first end;

b) a connector assembly comprising:

i) a movable member configured for positioning along the length of the strap, and ii) a fixed member that is attached to the second end of the strap, wherein connector has a connected configuration wherein the movable member and the fixed member are releasably connected, thereby forming a second loop in the flexible strap proximate the second end of the strap, and a disconnected configuration wherein the movable member and the fixed member are not connected.

2. The device according to claim 1 wherein the total length from the first end to the second end is about 8 feet to about 12 feet.

3. The device according to claim 2 wherein the total length from the first end to the second end is about 10 feet.

4. The device according to claim 1 wherein the width of the strap is at least about 1.5 inches, and up to about 4 inches.

5. The device according to claim 4 wherein the width of the strap is at least about 2 inches.

6. The device according to claim 2 wherein the fixed loop has a circumference of about 14 inches to about 18 inches.

7. The device according to claim 2 wherein the fixed loop has a circumference of about 16 inches.

8. The device according to claim 1 wherein the connector is a snap buckle.

9. An exercise device for use in assisting a person to stretch a targeted tissue in the body, consisting essentially of:

a) a flexible, inelastic strap having a first end, and a second end, and having at the first end a fixed loop formed in the flexible strap having a circumference sufficient in size to insert therethrough a part of the person body selected from the group consisting of the foot, hand, arm and leg; and b) a connector assembly comprising:

i) a movable member configured for positioning along the length of the strap, and ii) a fixed member that is attached to the second end of the strap, wherein connector has a connected configuration wherein the movable member and the fixed member are releasably connected, thereby forming a second loop in the flexible strap proximate the second end of the strap, and a disconnected configuration wherein the movable member and the fixed member are not connected.

10. The exercise device according to claim 9 wherein the fixed loop has a circumference of at least about 14 inches.

11. The exercise device according to claim 10 wherein the fixed loop has a circumference of up to about 18 inches.

12. The exercise device according to claim 9 wherein the width of the strap is at least about 1.5 inches, and up to about 4 inches.

13. The exercise device according to claim 12 wherein the width of the strap is at least about 2 inches.

14. The exercise device according to claim 10 wherein the total length from the first end to the second end is about 8 feet to about 12 feet.

15. A use of an exercise device for assisting a person to stretch a targeted tissue in the body, the use comprising the steps of:

1) providing an exercise device consisting essentially of:

a) a flexible, inelastic strap having a first end, and a second end, and having at the first end a fixed loop formed in the flexible strap having a circumference sufficient in size to insert therethrough a part of the person body selected from the group consisting of the foot, hand, arm and leg; and b) a connector assembly comprising i) a movable member configured for positioning along the length of the strap, and ii) a fixed member that is attached to the second end of the strap, wherein connector has a connected configuration wherein the movable member and the fixed member are releasably connected, thereby forming a second loop in the flexible strap proximate the second end of the strap, and a disconnected configuration wherein the movable member and the fixed member are not connected;

2) placing a part of the person's body into the fixed loop, the part of the body selected from the group consisting of the foot, arm, hand and leg;

3) manipulating the connector assembly into the connected configuration; and 4) placing another part of the person's body into the second loop.

16. The exercise device according to claim 15 wherein the fixed loop has a circumference of at least about 14 inches.

17. The exercise device according to claim 16 wherein the fixed loop has a circumference of up to about 18 inches.

18. The exercise device according to claim 15 wherein the fixed loop has a circumference of up to about 18 inches.

19. The exercise device according to claim 15 wherein the total length from the first end to the second end is about 10 feet.

* * * * *